US005485993A

United States Patent [19]

Lipsett

[11] Patent Number: 5,485,993

[45] Date of Patent: Jan. 23, 1996

[54] MOVABLE BASKETBALL TRAINING DEVICE

[76] Inventor: James D. Lipsett, 1248 Kerwin La., Manteca, Calif. 95336

[21] Appl. No.: 236,519

[22] Filed: Apr. 29, 1994

Related U.S. Application Data

[63] Continuation-in-part of Ser. No. 26,268, Mar. 4, 1993, abandoned, which is a continuation of Ser. No. 897,293, Jun. 11, 1992, abandoned.

[51] Int. Cl.[6] ..... A63B 69/00

[52] U.S. Cl. ..... 273/1.5 A

[58] Field of Search ..... 273/1.5 R, 1.5 A

[56] References Cited

U.S. PATENT DOCUMENTS

| | | |
|---|---|---|
| 2,932,516 | 4/1960 | Penner . |
| 3,025,058 | 3/1962 | Brumfield . |
| 3,304,089 | 2/1967 | Smith . |
| 3,451,677 | 6/1969 | Nedwick . |
| 3,552,749 | 1/1971 | Piggotte . |
| 3,716,234 | 2/1973 | Lancellotti . |
| 4,538,808 | 9/1985 | Holland . |
| 4,989,862 | 2/1991 | Curtis . |

*Primary Examiner*—Paul E. Shapiro

*Attorney, Agent, or Firm*—Flehr, Hohbach, Test, Albritton & Herbert

[57] ABSTRACT

A movable basketball training device for use by a basketball player on a basketball floor in the vicinity of an elevated basketball hoop and board. The training device includes first and second elongate arms which are spaced apart in a horizontal direction to simulate the outstretched arms of a basketball defender. Movable support means adapted to rest on the basketball floor is provided for supporting the first and second arms in a position above the basketball floor to withstand contact by a basketball player.

12 Claims, 3 Drawing Sheets

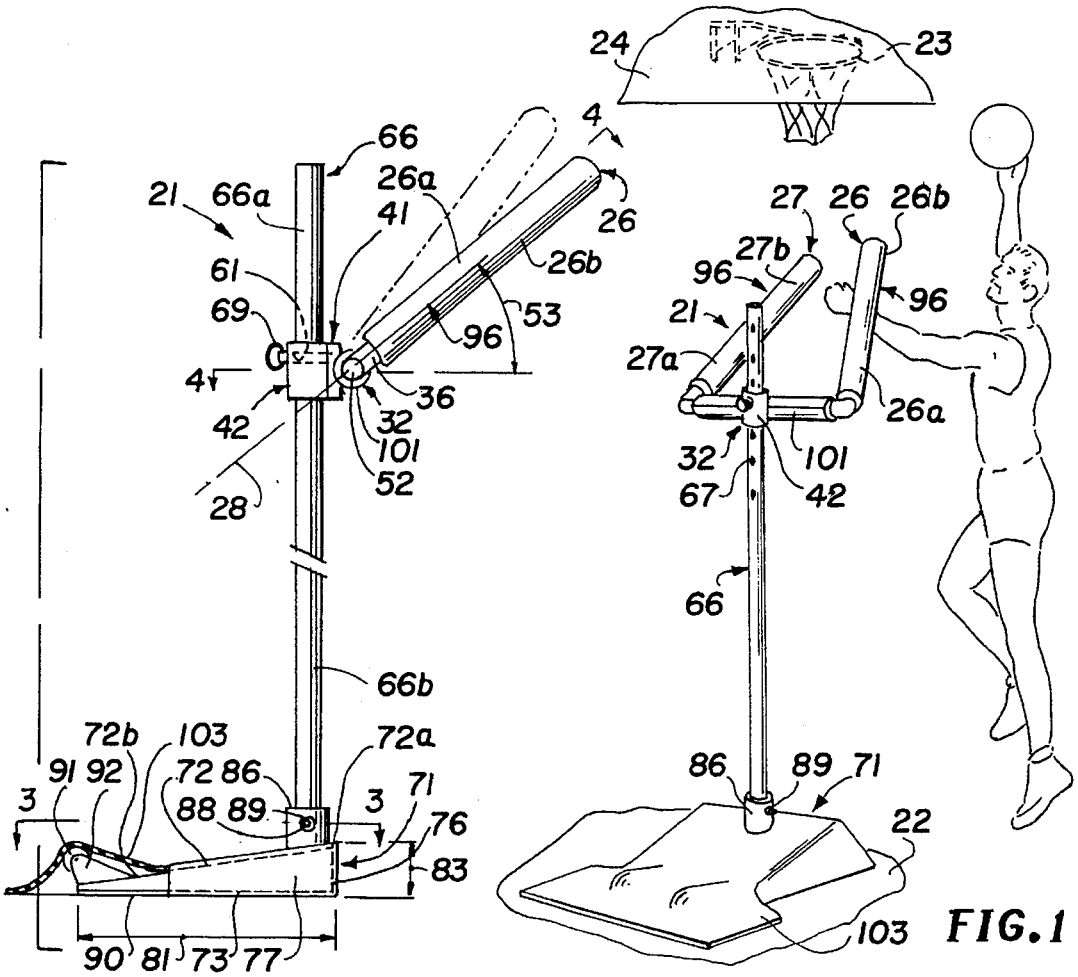
FIG.1
FIG.2
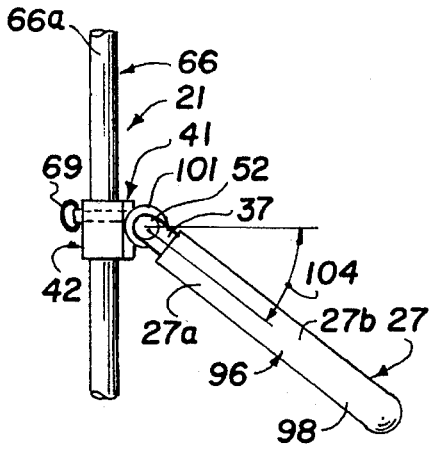
FIG.9
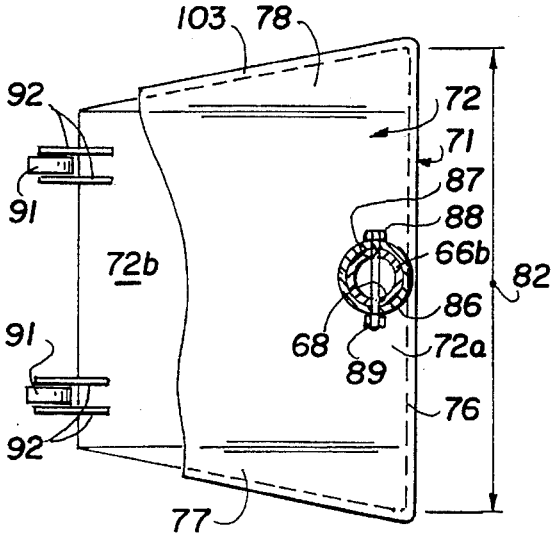
FIG.3

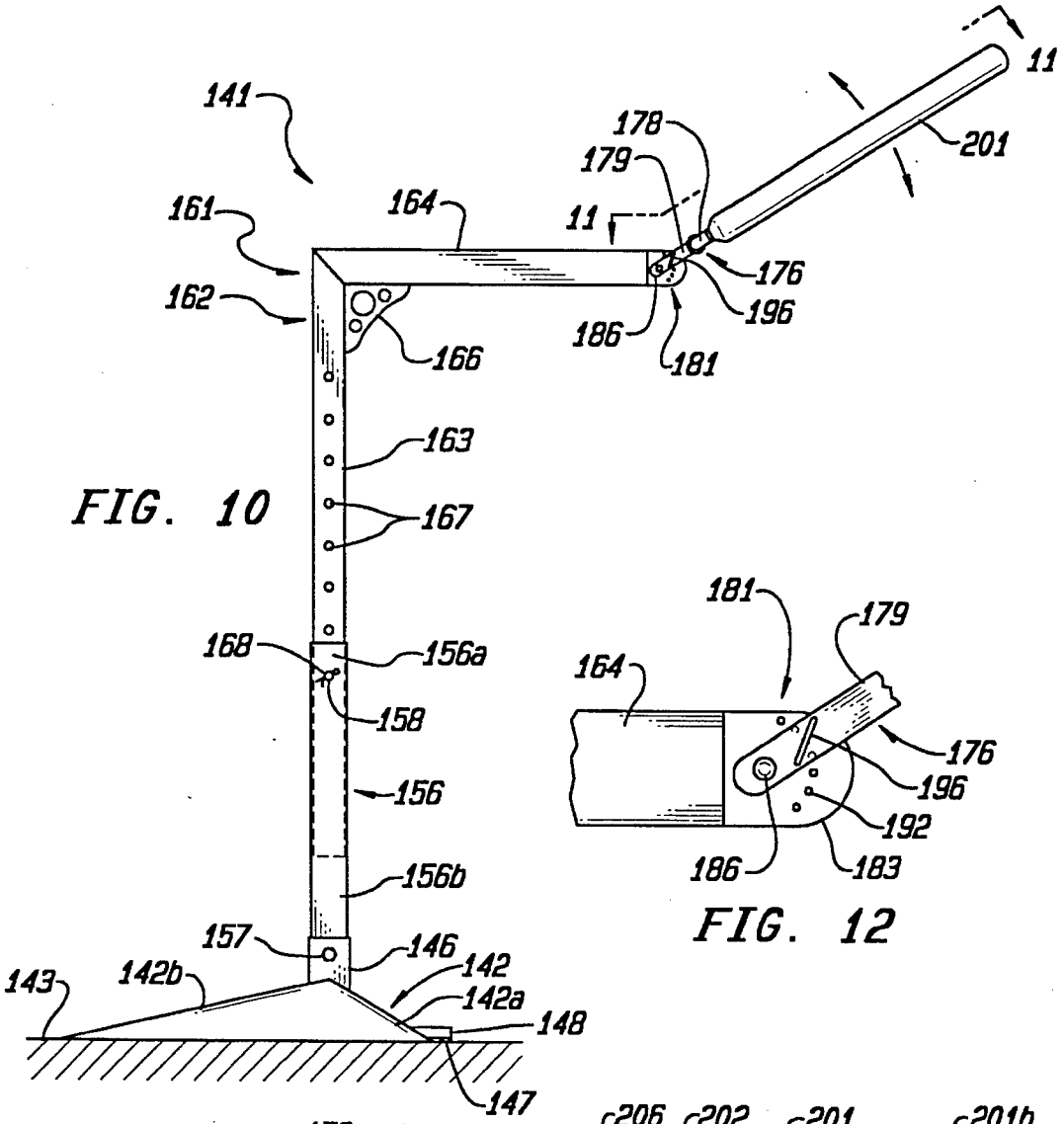
FIG. 10
FIG. 12
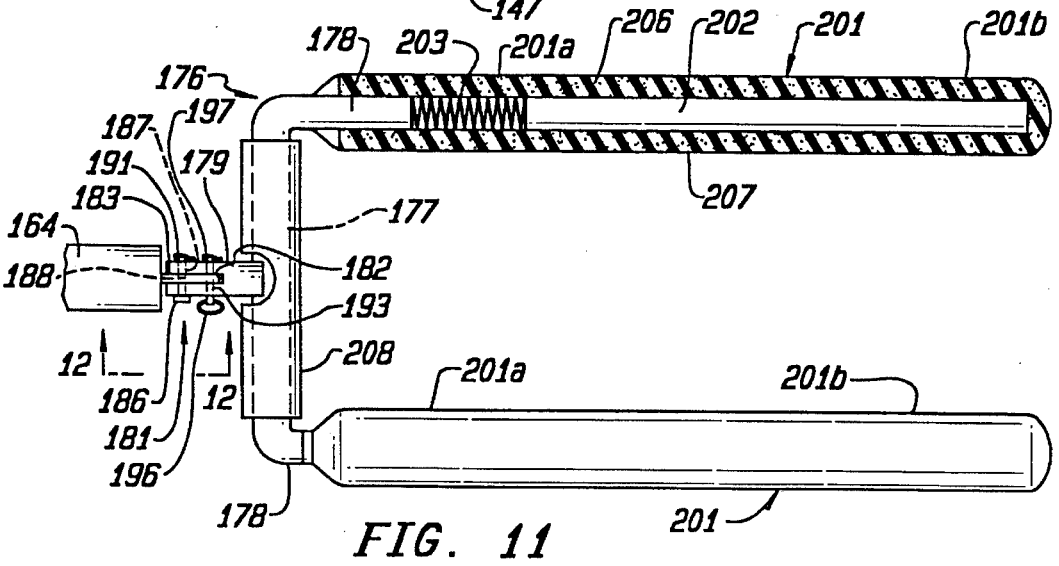
FIG. 11

MOVABLE BASKETBALL TRAINING DEVICE

This application is a continuation-in-part of application Serial No. 08/026,268 filed Mar. 4, 1993, which is a continuation of application Ser. No. 07/897,293 filed Jun. 11, 1992, abandoned.

This invention relates to athletic training equipment, and more particularly to athletic training equipment for the game of basketball.

Movable basketball training devices having arms which simulate the outstretched arms of a basketball defender have been provided for use on a basketball floor by basketball players. However, in general, such devices have a number of disadvantages. Most significantly, they are not designed for contact by a basketball player. In addition, the simulated arms are not bendable upon contact by a basketball player. There is therefore a need to provide a basketball training device which overcomes these disadvantages.

In general, it is one object of the present invention to provide a basketball training device having arms for simulating the outstretched arms of a basketball defender which can be impacted by a basketball player.

Another object of the present invention is to provide a training device of the above character having arms which are movable upon contact.

Yet another object of the present invention is to provide a training device of the above character which is movable about a basketball floor.

Another object of the present invention is to provide a training device of the above character which is durable.

In summary, the movable basketball training device of the present invention is for use by a basketball player on a basketball floor in the vicinity of an elevated basketball hoop and board. The training device has first and second elongate arms spaced apart in a horizontal direction to simulate the outstretched arms of a basketball defender. Movable support means adapted to rest on the basketball floor is provided for supporting the first and second arms in a position above the basketball floor to withstand contact by a basketball player.

Additional objects and features of the invention will appear from the following description from which the preferred embodiments are set forth in detail in conjunction with the accompanying drawings.

FIG. 1 is a rear elevational view of a movable basketball training device incorporating the present invention in use by a basketball player on a basketball floor in front of a basketball hoop and board.

FIG. 2 is a side elevational view, partly broken away, of the training device shown in FIG. 1.

FIG. 3 is a cross-sectional view, partly broken away, of the training device shown in FIG. 2 taken along the line 3—3 in FIG. 2.

FIG. 9 is a side elevational view of a portion of another embodiment of a movable basketball training device incorporating the present invention.

FIG. 10 is a side elevational view of another embodiment of a movable basketball training device incorporating the present invention.

FIG. 11 is a top elevational view, partly broken away, of the training device shown in FIG. 10 taken along the line 11—11 of FIG. 10.

FIG. 12 is a side elevational view of the training device shown in FIG. 10 taken along the line 12—12 of FIG. 11.

Figure 4:
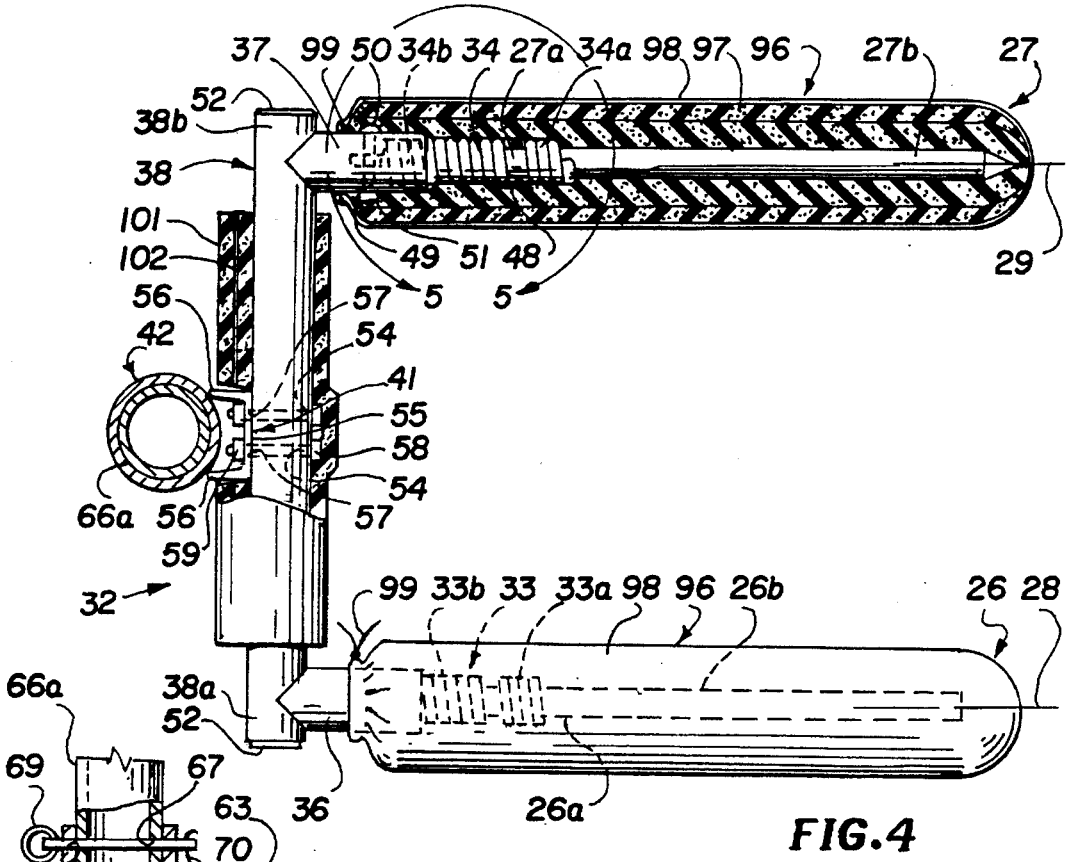
FIG. 4 is a cross-sectional view, partly broken away, of the training device shown in FIG. 2 taken along the line 4—4 in FIG. 2.

Reference will now be made in detail to the embodiments of the invention, which are illustrated in the accompanying figures. The description of the embodiments of the invention will be followed by a discussion of their operation. Turning now to the drawings, wherein like components are designated by like reference numerals throughout the various figures, attention is directed to FIGS. 1 through 9.

Movable basketball training device 21 incorporating the present invention simulates a basketball defender and is for placement upon a basketball floor 22 in the vicinity of or near an elevated basketball hoop 23 and board 24 (See FIG. 1). Training device 21 consists of first and second elongate rigid arms 26 and 27, with first arm 26 extending along a central longitudinal axis 28 and having proximal and distal extremities 26*a* and 26*b* and second arm 27 extending along a central longitudinal axis 29 and having proximal and distal extremities 27*a* and 27*b*. First and second arms 26 and 27 are each tubular in conformation and are provided with a transverse bore 31 extending across their diameter near the end of proximal extremities 26*a* and 27*a* for a purpose to be discussed below. Arms 26 and 27 are formed of a relatively solid and suitable lightweight material such as aluminum, and can vary in length from twenty to forty inches.

Training device 21 has movable means adapted to rest on basketball floor 22 for supporting first and second arms 26 and 27 in a position above the basketball floor to withstand contact by a basketball player. The support means includes bracket means coupled to arms 26 and 27 for supporting them in a spaced apart parallel home position to simulate the outstretched arms of a basketball defender. A bracket assembly 32 consisting of first and second helical springs 33 and 34, first and second collars 36 and 37, an interconnecting tube 38, a channel 41 and a movable sleeve 42 serves as the bracket means.

First and second helical springs 33 and 34 serve as first and second yieldable means coupled to proximal extremities 26*a* and 27*a* for permitting yieldable pivotal movement of distal extremities 26*b* and 27*b*, shown by dashed lines in FIG. 2, from home position, shown by solid lines in FIG. 2. Springs 33 and 34 have first end portions 33*a* and 34*a*, respectively, and second end portions 33*b* and 34*b*, respectively, and consist of a plurality of helical coils 46 and an end loop 47. They are made from a suitable material such as steel and can vary in length from four to eight inches. It should be appreciated by those skilled in the art that the force necessary to permit movement of arms 26 and 27 from their home positions can be changed by adjusting the stiffness of springs 33 and 34.

Figure 5:
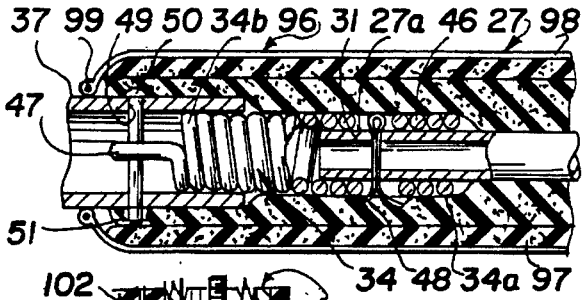
FIG. 5 is an enlarged view of a portion of the training device shown in FIG. 4 indicated by the reference line 5—5 in FIG. 4.

First end portions 33*a* and 34*a* of springs 33 and 34 are concentrically mounted around the exterior of first and second proximal extremities 26*a* and 27*a*, respectively, in axial alignment with first and second arms 26 and 27 and are secured thereto by a cotter pin 48 which extends between helical coils 46 and through bore 31 (See FIGS. 4 and 5). Second end portions 33*b* and 34*b* are mounted to the balance of bracket assembly 32 as discussed below.

Interconnecting tube 38 has first and second end portions 38*a* and 38*b* and serves to space first and second arms 26 and 27 apart in the horizontal direction (See FIG. 4). First and second collars 36 and 37 are each tubular in conformation and are welded or otherwise suitably mounted at one end on first and second end portions 38*a* and 38*b*, respectively, of tube 38 and concentrically mounted over the exterior of second end portions 33*b* and 34*b*, respectively, of springs 33 and 34. Collars 36 and 37 are provided with transverse bores 49 extending across their diameter and are secured to springs 33 and 34, respectively, by bolt 50 which extends through bores 49 and end loops 47 and is secured by nut 51. Tube 38 can vary in length from twelve to thirty inches and has end caps 52 sealing each end thereof as illustrated in FIG. 4. Alternatively, caps 52 can be eliminated and tube 38 remain within the scope of the present invention. As a further alternative, first and second collars 36 and 37 can each have ends cut at forty-five degree angles which are welded or otherwise suitably joined to the ends of tube 38, which are also cut at forty-five degree angles. Tube 38 and collars 36 and 37 are each formed from a suitable material such as steel.

Arms 26 and 27 extend at a fixed noncontact angle, indicated by angle 53 in FIG. 2, which is greater than fifteen degrees above the horizontal. More specifically, angle 53 can range from fifteen to eighty degrees. It should be appreciated that a training device 21 designed to permit adjustment of angle 53 would be within the scope of the present invention.

Interconnecting tube 38 is coupled to movable sleeve 42 by channel 41 and is provided with parallel and axially spaced apart transverse bores 54 extending across its diameter to facilitate this coupling. Channel 41 consists of a rectangular shaped plate 55 with generally parallel arms 56 extending perpendicularly from two opposite sides thereof and is provided with spaced apart bores 57 in plate 55 which align with bores 54. Channel 41 is mounted to tube 38 by bolt 58 which extends through bores 54 and 57 and is secured therein by nut 59 (See FIG. 4). Sleeve 42 is tubular in conformation with a length which can vary from five to eight inches, and is provided with a bore 61 extending through the diameter thereof for a purpose to be discussed below. Arms 56 are welded or otherwise suitably fastened to sleeve 42 such that tubular sleeve 42 is perpendicularly aligned with interconnecting tube 38 when bracket assembly 32 is assembled. Channel 41 and movable sleeve 42 are made from a suitable material such as aluminum.

Figure 6:
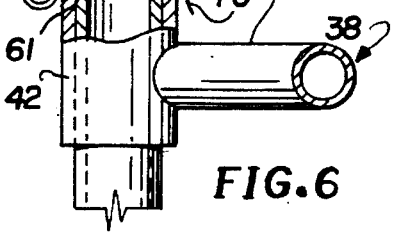
FIG. 6 is a cross-sectional view, partly broken away, of a portion of another embodiment of a movable basketball training device incorporating the present invention.

In an alternate embodiment, an extension tube 63 is welded or otherwise suitably joined to the middle of tube 38 at one end and to movable sleeve 42 at the other end (See FIG. 6). No channel is utilized. Extension tube 63 can range from three to eight inches in length and is made of a suitable material such as steel. In this embodiment, sleeve 42 is made of a suitable material such as steel that can be welded to extension tube 63.

The movable support means also includes an axially elongated tubular pole 66 having first and second portions 66*a* and 66*b* and provided with a plurality of parallel and axially spaced apart transverse bores 67 extending across the diameter of first portion 66*a* and a separate transverse bore 68 extending across the diameter of second portion 66*b*. Pole 66 can vary in length from five to eight feet and is made of a suitable material such as aluminum; bores 67 can commence approximately four feet from the end of second portion 66*b* and be spaced apart from two to seven inches.

Tubular movable sleeve 42 is slidably mounted to first portion 66*a* for placing arms 26 and 27 in an elevated position above basketball floor 22 and, together with bores 67 in first portion 66*a*, serves as means for adjusting the height of first and second arms 26 and 27 above basketball floor 22. A locking pin 69 having a grasping loop at one end extends through a bore 61 in movable sleeve 42 and a bore 67 in first portion 66*a* and is secured therein by a locking element 70 at its other end (See FIGS. 2 and 6). Locking pin 69 and locking element 70 serve as means for securing sleeve 42 to pole 66 to permit adjustment of the height of arms 26 and 27.

Tubular pole 66 is mounted in and extends upwardly from a base 71, which is also a part of the movable support means, so that first and second arms 26 and 27 extend out over basketball floor 22 away from base 71. Base 71 has first or top and second or bottom surfaces 72 and 73, first or front, second and third side surfaces 76, 77 and 78, and a length, a width and a height indicated by dimensions 81, 82 and 83 (See FIGS. 2 and 3). Top surface 72 has front and rear end portions 72*a* and 72*b*. Base 71 is made of a suitable material such as mild steel sheets formed and welded together and has a collar 86 mounted to it for receiving second portion 66*b* of pole 66. Collar 86 extends through the middle of front end portion 72*a* where it adjoins front side surface 76 and has a length which can vary from eight to twelve inches. Collar 86 is provided with a transverse bore 87 extending across the diameter thereof above top surface 72. Pole 66 is secured in collar 86 by bolt 88 which extends through bore 87 in collar 86 and bore 68 in second portion 66*b* and is secured therein by nut 89.

Base 71 has a conformation for retaining training device 21 in an upright and operable position during use and impact by a basketball player. Top surface 72 is substantially rectangular in shape, while second and third side surfaces 77 and 78 are generally triangular in shape. Bottom surface 73 and front side surface 76 are each generally in the shape of an isosceles trapezoid. Top surface 72 is downwardly and backwardly sloped from the corner where front end portion 72*a* adjoins the top base line of substantially vertical front side surface 76 to the corner where top surface 72 adjoins the rear base line of bottom surface 73. Each of second and third side surfaces 77 and 78 adjoin a leg line of front side surface 76 and are downwardly sloped from the corner where they adjoin top surface 72 to the corner where they adjoin a leg line of bottom surface 73. Length 81 and width 82 of base 71 are substantially greater than height 83. By way of example, length 81 can range from twenty to fifty inches, width 82 from twenty-five to fifty inches, and height 83 from three to eight inches. In addition, base 71 has a sufficient weight to counterbalance the weight of extending arms 26 and 27, bracket assembly 32 and pole 66.

Base 71 is adapted to rest on basketball floor 22 and has a rubber pad 90 affixed to bottom surface 73 for engagement with basketball floor 22. Most desirably, rubber pad 90 is made of a material which will not mark basketball floor 22 when contacting same. Base 71 also includes means for rolling training device 21 across basketball floor 22 to permit movement of training device 21 comprising rollers 91 mounted on rear end portion 72*b* of top surface 72 (See FIGS. 2 and 3). Rollers 91 are most desirably nonmarking and are obliquely fastened by a bracket 92 to top surface 72 for engagement with basketball floor 22 when training device 21 is tilted from its upright position with respect to basketball floor 22.

Training device 21 is padded to protect the basketball player from injury when contacting same. First and second arms 26 and 27, first and second helical springs 33 and 34 and first and second collars 36 and 37 are covered by removable arm padding 96 which includes one or more layers of tubular formed foam 97, such as high density pipe insulation, having an aggregate diameter ranging from four to six inches. Foam 97 is surrounded by a vinyl covering 98 which is open at one end to permit padding 96 to slip over and down the arm and rest against interconnecting tube 38. Covering 98 has a draw string 99 at its open end for closing that end and securing arm padding 96 in place. The portion of interconnecting tube 38 between first and second arms 26 and 27 is protected by foam padding 101 wrapped around interconnecting tube 38 and secured thereto by velcro strips 102 (See FIG. 4). Base 71 is covered by foam padding 103 which approximates the conformation of top surface 72 and has and opening from which collar 86 can protrude. Padding 103 is secured to base 71 by velcro or other suitable attachment means not shown in the drawings. It should be appreciated by those skilled in the art that other materials and methods for attachment could be used for padding training device 21 and be within the scope of the present invention.

For use, training device 21 is placed on basketball floor 22 and positioned in the desired location in the vicinity of basketball hoop 23 and board 24 to simulate a basketball defender. Padding 103 is fastened to base 71 before second portion **66*b* of pole 66 is inserted and secured in collar 86. Bracket assembly 32 is slidably positioned on first portion 66*a* of the pole with bore 61 in sleeve 42 aligned with the appropriate bore 67 on first portion 66*a* such that first and second arms 26 and 27 are at the desired elevation above basketball floor 22 when sleeve 42 is secured to pole 66 by locking pin 69 and locking element 70. Arm padding 96 is placed over first and second arms 26 and 27 and padding 101 is fastened to interconnecting tube 38**.

In operation, training device 21 can be used to simulate a basketball defender with upwardly outstretched first and second arms 26 and 27 attempting to prevent a player with a basketball from scoring. Most desirably, the basketball player attempts to shoot through arms 26 and 27. By way of example, training device 21 can be positioned close to hoop and board 23 and 24. The basketball player can set up for a shot in front of device 21 and then jump up pushing his arms and the basketball through arms 26 and 27. As another example, the basketball player can dribble up to training device 21 and block one or both of arms 26 and 27 with one of his arms and attempt a hook shot over device 21 with his other arm (See FIG. 1).

In another embodiment of training device 21, bracket assembly 32 can be inverted on first portion **66*a* of pole 66 so that first and second arms 26 and 27 extend downwardly at an angle 104 greater than fifteen degrees from the horizontal (See FIG. 9). In this embodiment, training device 21 simulates a basketball defender with outstretched arms attempting to steel the basketball or block a pass from a player dribbling with the ball. By way of example, the basketball player can attempt to dribble or pass through arms 26 or 27**.

First and second helical springs 33 and 34 coupled to proximal extremities **26*a* and 27*a* permit pivotal movement of distal extremities 26*b* and 27*b* with respect to the support means when arms 26 and 27 are impacted by a basketball player. Following impact, springs 33 and 34 cause arms 26 and 27 to return to their home position and serve to yieldably retain arms 26 and 27** in their noncontact home position until impacted again.

The conformation and composition of base 71 enhance the stability of training device 21 during its use. The relatively large surface area of bottom surface 73 serves as a stable platform which, together with the weight of steel base 71, counterbalance the forces imparted on arms 26 and 27 when contacted by a basketball player.

Training device 21 is designed to minimize the likelihood of a basketball player landing on base 71 while training with device 21. In this regard, pole 66 is mounted on base 71 adjacent front side surface 76 so that base 71 does not extend out under arms 26 and 27. In the embodiment shown in FIG. 6, arms 26 and 27 are further distanced from base 71 by extension tube 63.

Arm padding 96 protects a basketball player when contacting first and second arms 26 and 27. Should the basketball player slip down arms 26 and 27 and contact interconnecting tube 38, padding 101 protects the basketball player from injury as a result thereof. Padding 103 on base 71 protects the basketball player should he or she fall on base 71 or otherwise contact it during use of training device 21.

Movable sleeve 42, which is slidably mounted on pole 66, permits adjustment of the height of first and second arms 26 and 27 above basketball floor 22. The operator merely removes locking pin 69 from bores 61 and 67 in sleeve 42 and pole 66, respectively, adjusts arms 26 and 27 to a new elevation which corresponds with a bore 67 in pole 66 and secures sleeve 42 to pole 66 again with locking pin 69 and locking element 70.

Rollers 91 mounted on base 71 permit training device 21 to be moved about basketball floor 22. When training device 21 is in its upright operable position, rollers 91 are covered by padding 103 and do not engage basketball floor 22. Training device 21 is moved by tilting it back approximately ninety degrees from its upright position so that rollers 91 contact the basketball floor. When rollers 91 are so engaged with basketball floor 22, training device 21 can be rolled from one location to another.

It should be appreciated by those skilled in the art that other means for supporting first and second arms 26 and 27 could be used and be within the scope of the present invention. By way of example, in an alternate embodiment bracket assembly 32 includes collars 111 concentrically mounted around the exterior of each of first and second proximal extremities **26*a* and 27*a* in axial alignment with first and second arms 26 and 27. Each Collar 111 is provided with a transverse bore 113 extending across the diameter thereof and is secured to an arm 26 or 27 by a bolt 114 which extends through bore 113 in the collar and bore 31 in the arm and is secured therein by nut 115**.

Figure 8:
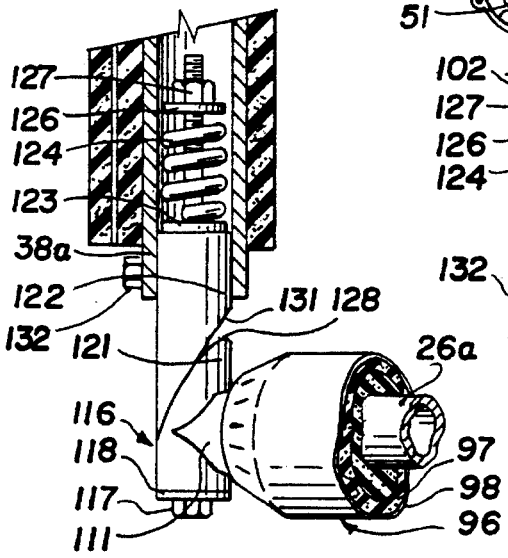
FIG. 8 is a top elevational view, partly broken away and similar to FIG. 7, of the training device shown in FIG. 7.
Figure 7:
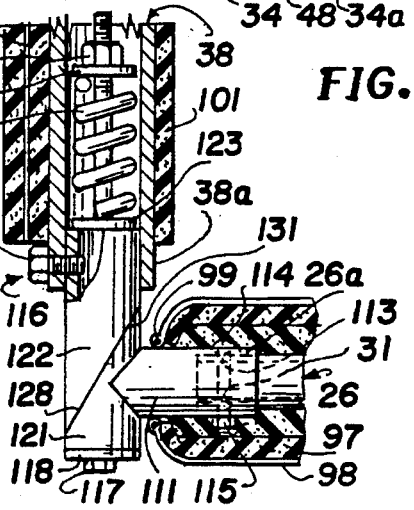
FIG. 7 is a top elevational view, partly broken away, of a portion of yet another embodiment of a movable basketball training device incorporating the present invention.

Collars 111 are coupled to each of first and second end portions **38*a* and 38*b* of interconnecting tube 38 by spring assemblies 116 which serve as the first and second yieldable means included in the support means (See FIGS. 7 and 8). Each spring assembly 116 consists of an axially elongated bolt 117 ranging in length from six to ten inches and carrying a first washer 118, first and second tubular portions 121 and 122, a second washer 123, a compression spring 124 and a third washer 126 secured thereon by a fastening nut 127 threadedly mounted to the end of bolt 117. Compression spring 124** can range in length from four to eight inches.

First and second tubular portions 121 and 122 have opposing ends 128 and 131 cut at the same oblique angle. Collar 111 is welded or otherwise suitably mounted to first tubular portion 121. Second tubular portion 122 is concentrically fastened within the related end portion **38*a* or 38*b* of interconnecting tube 38 by bolt 132 shown in FIGS. 7 and 8 or by other suitable mounting means. Arm 26 or 27 is yieldably retained in a home position extending at an angle 53 or 104 from the horizontal when oblique ends 128 and 131** are in offset engagement with each other.

In operation, spring assemblies 116 permit yieldable pivotal movement of distal extremities 26*b* and 27*b* with respect to the support means when first and second arms 26 and 27 are contacted by the basketball player. Within each spring assembly, movement of the related arm 26 or 27 causes ends 128 and 131 of first and second tubular portions 121 and 122 to slidably rotate with respect to each other. As ends 128 and 131 so rotate from their offset home position shown in FIG. 7, third washer 126 and fastening nut 127 are pulled against compression spring 124 by bolt 117 from their home position causing the spring to compress. After contact by the basketball player has ceased, compression spring 124 urges third washer 126 and fastening nut 127 back towards their home position. In turn, the third washer and the fastening nut cause bolt 117 to pull ends 128 and 131 back towards their offset home position. The tension of compression spring 124 can be adjusted by tightening or loosening fastening nut 127 on bolt 117.

In another embodiment of the present invention, a movable basketball training device 141 is provided having first and second arms which are adjustable upwardly and downwardly (see FIGS. 10 through 12). Training device 141 includes a weighted base 142 adapted to rest on a suitable support surface such as a basketball floor 143. Base 142 is substantially similar to base 71 described above and has a length ranging from 20 to 50 inches and preferably approximately 40 inches, and a width ranging from 25 to 50 inches and preferably approximately 40 inches. The base has a height of approximately 6 inches and has a weight ranging from 170 to 235 pounds and preferably approximately 170 pounds. Base 142 includes front and rear portions 142*a* and 142*b* and is further provided with a tubular collar 146 mounted in general vertical disposition at the juncture of the front and rear portions. A pair of horizontally spaced apart rollers 147 are mounted to the edge of front portion 142*a* by a pair of first and second brackets 148.

A single upstanding tubular pole member or pole 156 having top and bottom end portions 156*a* and 156*b* is mounted in an upright position to base 142. Pole 156 can be made from any suitable material such as aluminum and has a height of approximately four feet and a diameter of approximately four inches. Bottom end portion 156*b* of the pole is disposed within collar 146 and secured thereto by a nut and bolt assembly 157 extending through aligned bores (not shown) provided in the collar and the bottom end portion of pole 156. Top end portion 156*a* is provided with a bore 158 extending diametrically through the pole.

A mounting means or assembly 161 is carried by pole 156 and includes an extension member 162 formed from a first or vertical tube 163 and a second or horizontal tube 164 having ends secured together at a right angle. Tubes 163 and 164 are made from any suitable material such as aluminum and are joined together by any suitable means such as welding. Vertical tube 163 has a height of approximately 60 inches and horizontal tube 164 has a length of approximately 35 inches; each of the tubes has a diameter of approximately three inches. A metal brace 166 is welded or otherwise suitably joined to the coupled ends of tubes 163 and 164 for further support. Vertical tube 163 is slidably mounted within pole 156 and is provided with a plurality of bores 167 extending diametrically therethrough and spaced apart along the length of the vertical tube at distances ranging from approximately 5 to 12 inches. Releasable means which includes locking pin 168 extends through one of bores 167 of vertical tube 163 and bore 158 of pole 156 for locking the vertical tube to the pole at a fixed elevational position.

A crosspiece is mounted to the free end of horizontal tube 164 for pivoting thereabout in the plane of tubes 163 and 164. Crosspiece 176 is generally "U"-shaped and is formed from a tube made from any suitable material such as aluminum and having a diameter of approximately one and one-half inches. The crosspiece includes a cross arm portion 177 having a length of approximately 17 inches and parallel first and second stub portions 178 extending from each end of the cross arm in the same direction. Crosspiece 176 further includes a shank portion 179 formed from similar tubing and welded or otherwise suitably joined to the middle of cross arm portion 177 so as to extend in an opposite direction from stub portions 178.

A pivot means or assembly 181 is carried by shank portion 179 and extension member 162 and includes a longitudinally disposed slot 182 extending through the end of the shank portion for receiving a plate or tongue 183 welded or otherwise suitably joined in vertical disposition to the free end of horizontal tube 164. A pivot pin 186 extends through transversely aligned bores 187 in shank portion 179 and a centrally disposed bore 188 in tongue 183 and is secured about the shank portion by a locking clip 191 which extends through the end of the pivot pin.

Means is provided for locking crosspiece 176 in several predetermined angular positions relative to extension member 162 and includes a plurality of angular spaced-apart bores 192 extending through tongue 183 and radially spaced from bore 188 a generally equal distance. An additional locking bore 193 extends transversely through shank portion 179 for alignment with bores 192 so as to permit a locking pin 196 to extend through bore 193 and one of bores 192. Locking pin 196 is secured within bores 193 and 192 by a locking clip 197 disposed in a bore (not shown) provided in the distal end of the pin. Crosspiece 176 can pivot upwardly and downwardly and be locked in a variety of angular positions both above and below the horizontal.

Parallel spaced-apart first and second elongate arms 201 similar in operation to arms 26 and 27 are carried by crosspiece 176 and have proximal and distal extremities 201*a* and 201*b*. Arms 201 can vary in length from 20 to 40 inches and each include a tube 202 made from any suitable material such as aluminum and having a diameter of approximately one and one-half inches. Yieldable means in the form of coil springs 203 serve to secure arms 201 in spaced-apart position to crosspiece 176. Each coil spring 203 has a length of approximately six inches and a diameter of approximately one and one-half inches and is welded or otherwise suitably joined at one end to the free end of stub portion 178 and at the other end to the extremity of tube 202. Each arm 201 further includes padding in the form of foam 206 and cover 207 which extend down tube 202, coil spring 203 and stub portion 178. Tubular padding 208 similar to padding 101 extends around cross arm portion 177. As so formed, training device 141 has an aggregate weight ranging from 220 to 300 pounds and preferably approximately 230 pounds.

In operation and use, training device 141 is placed on basketball floor 143 in the vicinity of an elevated basketball hoop and board so that padded elongate arms 201 extend upwardly and away from the basket. The upwardly outstretched elongate arms 201 simulate the arms of a defensive basketball player or defender. A basketball player moves beneath the padded arms and attempts to make a shot through the elongate arms. During the act of shooting, the basketball is raised to the shooting position and the basketball player pushes the ball through the elongate arms toward the basket. The arms of the basketball player engage elongate arms 201 of training device 141 while shooting. Coil spring 203 is sized so that elongate arms 201 provide a significant resistance which must be overcome by the basketball player in order to make a basket.

Weighted base 142, pole 156, mounting assembly 161 and crosspiece 176 are included within the means of training device 141 for retaining the device in a stationary upright position while the basketball player engages the device during shooting. Training device 141 is configured so that the basketball player must engage one or both of elongate arms 201 while shooting. The generally flat conformation and significant weight of base 142 contribute to the stability of the training device and permit the basketball player to repeatedly engage and shoot through elongate arms 201. In this manner, the training device enables the basketball player to practice scoring while being fouled so as to be possibly entitled to an additional foul shot and consummate a three point play.

The region in front of and to the side of elongate arms 201 is generally free of obstructions to permit the basketball player to shoot baskets from multiple positions about training device 141. Extension member 162 projects the elongate arms out over the basketball floor away from weighted base 142. These features of training device 141 allow the basketball player considerable freedom in approaching the elongate arms to shoot.

Mounting assembly 161 permits elongate arms 201 to be adjustable in height relative to pole 156 and pivot assembly 181 permits the elongate arms to adjust in angular position relative to the horizontal. The vertical height of the elongate arms is changed by sliding extension member 162 upwardly or downwardly within pole 156 and permits training device 141 to accommodate basketball players of various sizes. The elongate arms can be angularly adjusted to a variety of predetermined positions ranging from approximately fifteen to eighty degrees both above and below the horizontal. Elongate arms 201 positioned above the horizontal simulate a defender attempting to block a shot. Elongate arms positioned below the horizontal simulate a defender attempting to steal or otherwise strip the basketball from an offensive player.

In view of the foregoing, it can be seen that the movable basketball training device of the present invention is an improvement over the prior art and overcomes the disadvantages thereof. The training device has arms for simulating the outstretched arms of a basketball defender which are designed for contact by a basketball player and are movable upon contact. In addition, the training device is movable about a basketball floor and is durable.

What is claimed is:

1. A movable basketball training device for use by an offensive basketball player on a basketball floor in the vicinity of an elevated basketball hoop and board comprising a weighted base adapted to rest on said basketball floor, an upstanding member mounted to the weighted base and extending upwardly therefrom, first and second elongate arms having proximal and distal extremities and mounting means coupled to the proximal extremities of the elongate arms for supporting the elongate arms on the upstanding member in horizontally spaced apart home positions, the mounting means including first and second yieldable means coupled to the proximal extremities of the elongate arms for permitting yieldable pivotal movement of the distal extremities of the elongate arms from the home positions and means for positioning the proximal extremities of the elongate arms forward of the weighted base, releasable means carried by the upstanding member and the mounting means for positioning the elongate arms above the basketball floor at a predetermined elevation, the upstanding member and the mounting means forming means for extending at least the distal extremities of the elongate arms over the offensive basketball player so that the offensive basketball player must engage the elongate arms while shooting, the region in front of and to the side of the elongate arms exclusive of the elongate arms being free of obstructions to permit the offensive basketball player considerable freedom in approaching the device and moving to the shooting position, whereby the elongate arms simulate the physical constant of the outstretched arms of a defensive basketball player during shooting exercises by the offensive basketball player.

2. A movable basketball training device as in claim 1 wherein said weighted base, upstanding member and mounting member form means for retaining the device in a stationary upright position while being contacted by the offensive basketball player.

3. A movable basketball training device as in claim 1 wherein said mounting means includes a pivot assembly having a pivot for permitting the distal extremities of the elongate arms to pivot upwardly and downwardly relative to the horizontal.

4. A movable basketball training device as in claim 3 wherein said pivot assembly includes means for locking the elongate arms relative to the pivot.

5. A movable basketball training device as in claim 1 wherein said means for positioning the proximal extremities of the elongate arms forward of the weighted base includes a member extending horizontally of the upstanding member forward of the weighted base.

6. A movable basketball training device as in claim 1 wherein said first and second yieldable means comprise helical springs.

7. A movable basketball training device as in claim 1 wherein padding covers said first and second elongate arms for protecting said basketball player from injury when contacting the elongate arms.

8. A movable basketball training device as in claim 1 wherein said weighted base has an edge and includes roller means mounted along said edge to permit movement of the training device on said basketball floor.

9. A movable basketball training device for use by a basketball player to make physical contact therewith on a basketball floor in the vicinity of an elevated basketball hoop and board comprising movable support means adapted to rest on said basketball floor in a position adjacent the basketball hoop and from which a basketball player can attempt to make a shot, said movable support means including a weighted base and a single upstanding pole member mounted on the weighted base, a cross arm, mounting means releasably securing the cross arm to the pole member in positions adjustable in height on the pole member above the weighted base, first and second elongate arms having proximal extremities and yieldable means coupled to the proximal extremities for securing the elongate arms in spaced apart positions on the cross arm facing forwardly of the cross arm at angular positions from the horizontal so as to simulate the outstretched arms of an opposing basketball player, the mounting means including a member extending horizontally of the upstanding pole member for positioning the proximal extremities of the elongate arms forward of the weighted base, the first and second elongate arms being positionable so that each time the basketball player shoots a basket the basketball player must physically engage one or both of the elongate arms, the weighted base, the pole member, the mounting means and the cross arm forming means for withstanding the physical contact by the basketball player during the shooting of baskets by the basketball player and for retaining the device in a stationary upright position while being physically contacted by the basketball player, the region in front of and to the side of the elongate arms exclusive of the elongate arms being free of obstructions to permit the basketball player to shoot baskets from multiple positions about the device, whereby the device enables the basketball player to practice drawing a foul while shooting.

10. A movable basketball training device as in claim 9 wherein said elongate arms are spring loaded into a home position and are deflectable from the home position when they are struck by the basketball player making a shot.

11. A movable basketball training device as in claim 9 together with padding covering said elongate arms to prevent injury to the basketball player and wherein said mounting means includes a sleeve slidably mounted on said pole member, said sleeve being removable and in one position being in an upright position and in another position being in an upside down position, said elongate arms extending upwardly when said sleeve is in the upright position and extending downwardly when the sleeve is in the upside down position.

12. A method for training a basketball player to shoot basketballs under simulated bodily contact with the aid of a basketball training device which simulates an opposing basketball player and includes weighted base adapted to rest on said basketball floor, an upstanding member mounted to the weighted base and extending upwardly therefrom, first and second elongate padded arms having proximal and distal extremities and mounting means coupled to the proximal extremities of the padded arms for supporting the padded arms on the upstanding member in horizontally spaced apart home positions, the mounting means including first and second yieldable means coupled to the proximal extremities of the padded arms for permitting yieldable pivotal movement of the distal extremities of the padded arms from the home positions and means for positioning the proximal extremities of the padded arms forward of the weighted base, releasable means carried by the upstanding member and the mounting means for positioning the padded arms above the basketball floor at a predetermined elevation, comprising the steps of placing the training device on a basketball floor in the vicinity of an elevated basketball hoop and board so that the padded arms extend away from the hoop and board, causing the basketball player to move beneath the padded arms and to repeatedly shoot the basketball while physically engaging the padded arms and causing the basketball player to change positions between shots so as to shoot from different angles about the training device, whereby the device enables the basketball player to practice drawing a foul while shooting.

* * * * *